United States Patent [19]

Reese et al.

[11] 4,183,217

[45] Jan. 15, 1980

[54] PRESSURE LIMITING PROPELLANT ACTUATING SYSTEM

[75] Inventors: Paul B. Reese, Los Angeles; David W. Murphy, Garden Grove, both of Calif.

[73] Assignee: The United States of America as represented by the Administrator of the National Aeronautics and Space Administration, Washington, D.C.

[21] Appl. No.: 931,218

[22] Filed: Aug. 4, 1978

[51] Int. Cl.[2] ..... F01B 29/08

[52] U.S. Cl. ..... 60/632

[58] Field of Search ..... 60/632, 636, 638

[56] References Cited

U.S. PATENT DOCUMENTS

| | | | |
|---|---|---|---|
| 2,815,008 | 12/1957 | Hirt | 60/636 |
| 2,979,904 | 4/1961 | Royer | 60/632 |
| 3,031,845 | 5/1912 | Ludwig | 60/632 |
| 3,645,091 | 2/1972 | Ivanov et al. | 60/632 |

*Primary Examiner*—Wendell E. Burns

*Attorney, Agent, or Firm*—Carl O. McClenny; John R. Manning; Marvin F. Matthews

[57] ABSTRACT

A pressure limiting propellant actuating system includes an outer barrel housing having a combustion chamber formed therein. A main piston is movable in the barrel housing when a pressure is developed in the combustion chamber. A relief piston is concentrically mounted and fixedly movable with the main piston when the gas pressure is exerted thereon from the combustion chamber. The relief piston includes a separation mechanism for limiting the output force and simultaneously, maintaining output pressure from the combustion chamber.

5 Claims, 3 Drawing Figures

PRESSURE LIMITING PROPELLANT ACTUATING SYSTEM

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 45 U.S.C. 2457).

BACKGROUND OF THE INVENTION

1. Field of the Invention

The field of art to which the invention pertains includes the field of propellant actuating systems, particularly with respect to a non-venting pressure relief piston that allows equivalent thruster output force when either of a plurality of pressure cartridges are fired.

2. Description of the Prior Art

In conventional pyrotechnic thruster designs, redundant design requires that dual cartridges be utilized. However, the firing of a single cartridge must accomplish the intended function. When a dual firing occurs, which normally would produce double the normal required thruster output force, this additional force is normally absorbed by the mechanism being actuated. However, where the pressure exerted by the thruster on the mechanism must be within a specified range, and the pressure must be maintained on the mechanism subsequent to actuation, conventional techniques such as venting of excess pressure cannot be utilized since the thruster force must be maintained on the mechanism by the gas pressure developed by the thruster.

Known prior act includes U.S. Pat. Nos. 3,656,296; 3,557,550; 3,484,846; 3,112,670; 3,031,845; and 3,024,749.

SUMMARY OF THE INVENTION

The present invention provides a propellant actuating system including an outer barrel outer housing having a combustion chamber formed therein. A main piston is movable in the barrel housing when gas pressure is developed in the combustion chamber. A relief piston is concentrically mounted and fixedly movable with the main piston when the gas pressure is exerted thereon from the combustion chamber. The relief piston has a separation mechanism for limiting the output force and simultaneously maintaining the output pressure on the main piston from the combustion chamber.

The advantages of this invention, both as to its construction and mode of operation, will be readily appreciated as the same becomes better understood by reference to the following detailed description when considered in connection with the accompanying drawings in which like reference numerals designate like parts throughout the Figures.

DESCRIPTION OF THE PREFERRED EMBODIMENTS

Figure 1:
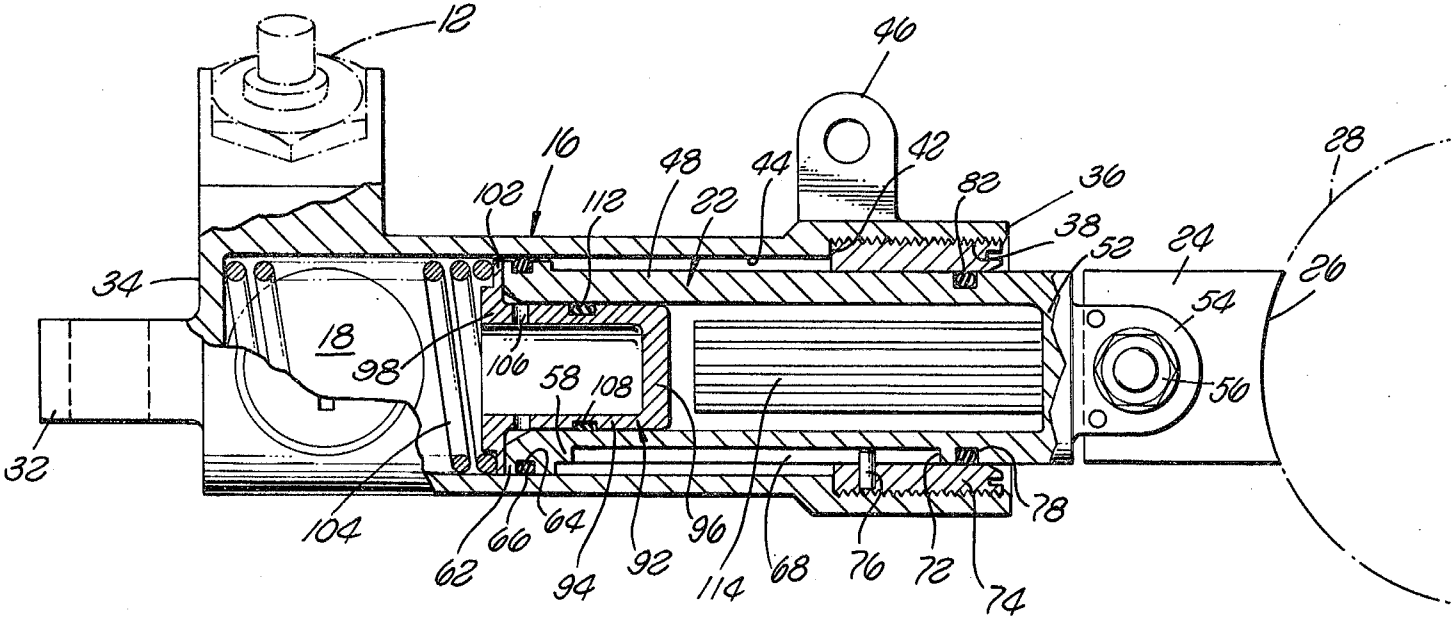
FIG. 1 is a longitudinal sectional view of the actuating system prior to firing of a pyrotechnic device.

Referring now to the drawings there is shown in FIG. 1 a pressure limiting actuation system constructed in accordance with principles of the invention. Propellant actuating devices are housed in first cartridge 12 and a second cartridge (not shown in FIG. 1) at one end of a housing barrel 16. When the propellant actuating devices are fired, gas pressure in the adjacent combustion chamber 18 of the housing barrel is utilized to move a main piston 22 a predetermined distance outside of the open end of the barrel 16. The exterior end of the piston 22 is coupled to an output foot 24. As illustrated in FIG. 1 the output foot contains a curved surface 26 which abuts a member 28 (shown in dotted lines). The member 28 in turn is moved as the output foot 24 moves due to the sliding action of the main piston 22. The second cartridge is identical to and is positioned directly behind the first cartridge 12, when viewed in FIG. 1.

The present invention utilizes dual cartridges which are redundant, the firing of a single cartridge accomplishing the intended function of moving the main piston 22, and hence, member 28 a desired distance. In conventional prior art redundant designs, the excess pressure generated by the additional propellant actuating device can normally be bled off. However, in the present application it is necessary that the member 28 be retained in a predetermined position by the output foot 24 once the propellant actuating devices have been fired. Therefore, gas pressure bleeding techniques cannot be utilized.

Referring now to FIG. 1 in greater detail, the housing barrel 16 contains a first fixed mounting lug 32 at the housing barrel closed end 34 adjacent combustion chamber 18. The other end 36 of the housing barrel 16 is open enabling slidable movement of the main piston 22 therefrom. The barrel open end 36 contains an enlarged diameter threaded bore portion 38 which terminates at a shoulder 42 facing the barrel open end. A reduced diameter bore 44 extends from the shoulder 42 to the barrel closed end 34. The portion of the reduced diameter bore 44 adjacent the closed end defines the combustion chamber 18. A second fixed mounting lug 46 extends from the outer surface of the housing barrel 16 adjacent the enlarged diameter threaded bore 38. Additional mounting lugs, of course, could be secured to the housing barrel 16, if necessary.

The main piston 22 is formed of a cylindrical sleeve 48 having an outer diameter slightly less than the barrel reduced diameter bore 44. The main piston cylindrical sleeve 48 as an end wall 52 at its portion extending beyond the barrel open end 36. A flange 54 extends from the end wall and is utilized to secure the main piston 22 to the output foot 24 by means of a bolt 56.

The other end of the main piston terminates in an outwardly turned flange 48 whose outer edge 62 diameter is approximately equal to the diameter of the housing barrel 16 reduced diameter bore 44. A groove 64 formed in the flange edge 62 has an O-ring 66 positioned therein which forms a dyamic seal for preventing gas leakage from the combustion chamber 18 to the atmosphere. A longitudinally extending slot 68 is formed on the outer surface of the the main piston cylindrical sleeve and extends from the flange 58 to a shoulder 72 adjacent the piston end wall 52. When the main piston 22 is loaded into the housing barrel 16, a retaining sleeve 74 is threadably secured in the barrel enlarged diameter bore 38. The retaining sleeve 74 contains an anti-rotation pin 76 which is slidably movable in the main piston slot 68 and prevents rotation of the main piston 22.

A groove 78 is formed in the main piston outer surface intermediate the piston end wall 52 and the slot shoulder 72. An O-ring environmental seal 82 is positioned in the piston groove 78 which is adjacent the retaining sleeve 74 in the initial position of FIG. 1.

To maintain the relief pressure necessary when both actuating devices fire, a relief piston 92 is positioned in the main piston 22 adjacent to the combustion chamber 18. The relief piston 92 is formed of a cylindrical sleeve 94 whose outer diameter is slightly less than the inner diameter of the main piston. The relief piston sleeve 94 is substantially shorter than the main piston sleeve 48 and is positioned therein adjacent the combustion chamber. The cylindrical sleeve 94 contains an end wall 96 at its end communicating with the interior of the main piston sleeve 48 and is open adjacent the combustion chamber 18. An outwardly extending flange 98 is formed at the open end of the relief piston cylindrical sleeve 94 and extends to the interior surface of the barrel reduced diameter bore 44. The relief piston flange 98 abuts the main piston flange 58 on one side thereof and has a reduced thickness portion 102 formed on the other side thereof adjacent the combustion chamber. The portion 102 enables a compression spring 104 to be positioned in the combustion chamber intermediate the barrel interior end 34 and portion 102. When the main piston 22 moves due to the gas pressure in the combustion chamber, the compression spring 104 provides a force sufficient that the main piston 34 moves the desired distance out of the housing barrel 16. In this regard it should be noted that the retaining sleeve 74 forms a stop for the main piston flange 58 along the plane of the barrel shoulder 42.

A plurality of gas ports 106 are formed in the relief piston cylindrical sleeve 94 and extends from the interior of the sleeve to adjacent the interior surface of the main piston sleeve 48 and flange 54. The gas ports 106 enable a predetermined amount of gas to leak in the surface area intermediate the outer surface of the relief piston sleeve 94 and the inner surface of the main piston sleeve 48. A groove 108 formed on the outer surface of the sleeve piston sleeve 94 contains an O-ring 112 therein. The dimensions of the groove 108 are chosen such that when gas pressure leaks through the ports 106, the relief piston 92 fractures along the groove 108 plane at a predetermined pressure which is exceeded only when both actuating devices contained in the cartridges fire. Fracturing of the relief piston 92 along the plane of groove 108 causes separation of the end wall 96 and the adjacent portion of the sleeve 94. The gas pressure then forces this portion of the relief piston 92 towards the main piston end wall 52. A crushable honeycomb is positioned in the area of the main piston intermediate the main piston end wall 52 and the relief piston end wall 96. The honeycomb acts as a attenuator so that when the relief piston 92 fractures, it will not hit the main piston end wall 52 with such force as to damage the output foot 24 or the member 28. It should be noted that when the relief piston 92 fractures, the volume adjacent the combustion chamber 18 is increased sufficiently so that additional volume is provided for gas expansion in the combustion chamber.

Figure 2:
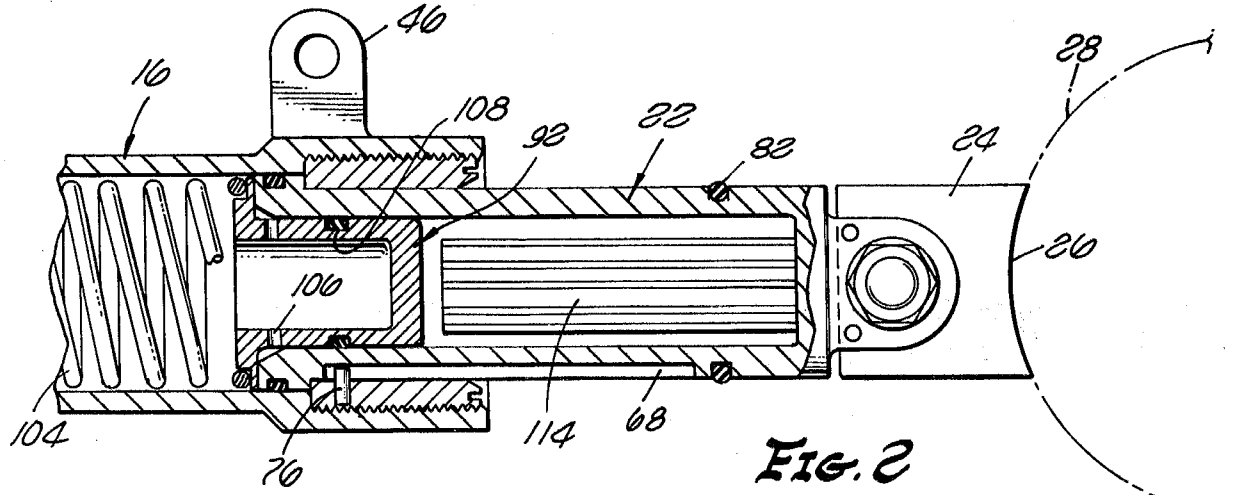
FIG. 2 is a cross sectional view of the device of FIG. 1 where one of the pyrotechnic devices have been fired.
Figure 3:
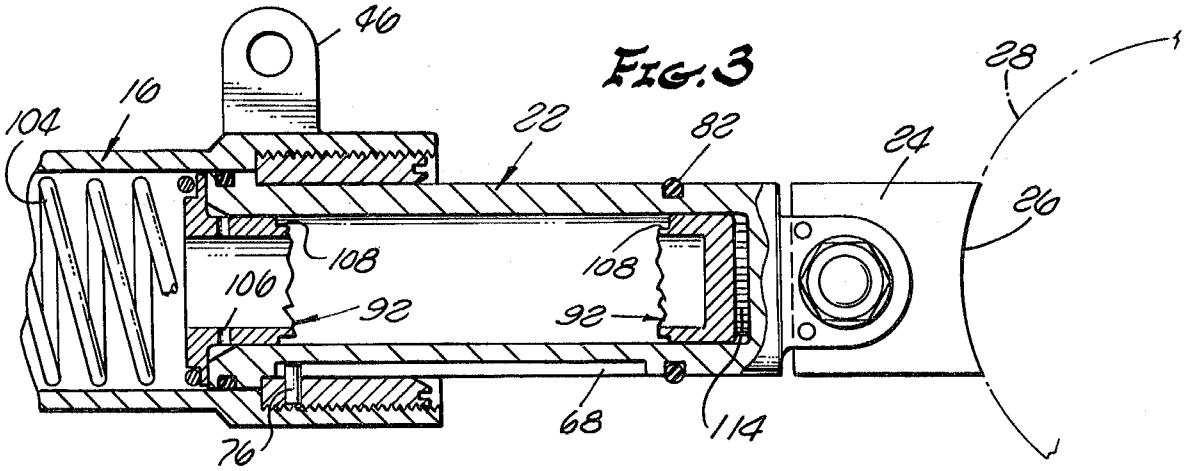
FIG. 3 is a cross sectional where both of the pyrotechnic devices have been fired.

FIG. 2 illustrates the movement of the main piston and the relief piston when only a single actuating device has fired. In such an instance the relief piston 92 remains intact and the main piston 22 is forced out of the barrel 16 until the main piston flange 54 abuts the retaining sleeve 74. FIG. 3 illustrates the fracturing of the relief piston 92, forming an additional volume and, thus, relieving pressure adjacent the combustion chamber 18, as when both pyrotechnic devices fire. It should be noted that the honeycomb 114 is crushed intermediate the relief piston end wall 96 and the main piston end wall 52. However, the main piston 22 has travelled the same distance as the main piston flange 58 abuts the retaining sleeve 74.

We claim:

1. A pressure limiting propellant actuating system comprising;
   - an outer barrel housing having a combustion chamber therein;
   - a main piston movable in said barrel housing when gas pressure is developed in said combustion chamber;
   - a relief piston concentrically mounted and fixedly movable with said main piston when said gas pressure is exerted thereon from said combustion chamber, said relief piston having separation means for limiting the output force and, simultaneously, maintaining a predetermined gas pressure from said combustion chamber.

2. A pressure limiting propellant actuating system in accordance with claim 1 wherein said separation means enables a portion of relief piston to move with respect to said main piston for increasing the volume of the cavity formed between main piston and said combustion chamber.

3. A pressure limiting propellant actuating system in accordance with claim 2 wherein means are provided for impeding the travel of said relief piston portion within said main piston for controlling the rate of gas expansion in said cavity.

4. A pressure limiting propellant actuating system in accordance with claim 3 wherein said impeding means includes a honeycomb.

5. A pressure limiting propellant actuating system in accordance with claim 3 wherein said separation includes gas ports formed in said relief piston for enabling gas in said gas chamber to exert a pressure on a groove formed on said relief piston.

* * * * *